US005168893A

United States Patent [19]

Benson

[11] Patent Number: 5,168,893

[45] Date of Patent: Dec. 8, 1992

[54] BLOCK AND BLEED VALVE

[75] Inventor: Dan Benson, Joplin, Mo.

[73] Assignee: Ingersoll-Rand Company, Woodcliff Lake, N.J.

[21] Appl. No.: 789,501

[22] Filed: Nov. 8, 1991

[51] Int. Cl.[5] ..... F04B 49/02

[52] U.S. Cl. ..... 137/595; 417/28; 417/317

[58] Field of Search ..... 137/595, 627.5, 625.18; 417/28, 316, 317

[56] References Cited

U.S. PATENT DOCUMENTS

| | | | |
|---|---|---|---|
| 1,394,900 | 10/1921 | Hibner | 137/595 X |
| 2,666,449 | 1/1954 | Teague, Jr. | 137/595 X |
| 2,738,806 | 3/1956 | Reynolds | 137/595 |
| 2,961,147 | 11/1960 | Osterkamp | 417/28 |
| 3,147,772 | 9/1964 | Stelzer et al. | 137/595 X |
| 4,339,897 | 7/1982 | Thompson et al. | 137/595 X |

*Primary Examiner*—John Rivell

*Attorney, Agent, or Firm*—Glenn B. Foster

[57] ABSTRACT

A valve for use with a first working fluid conduit and a second working fluid conduit, the valve includes a valve body with a valve bore formed therein. A piston is slidably disposed within the valve body. There is a first opening and a second opening formed within and defined by the valve body. The first opening is in communication with the first working fluid conduit and the second opening is in communication with the second working fluid conduit. Displacement of the piston in a first direction to a first position results in restriction of working fluid passage through the second working fluid conduit. Displacement of the piston in a second direction, opposed to the first direction, to a second position results in restriction of working fluid passage through the first working fluid conduit. There is a spring which biases the piston into the second position. There is also a variable displacing fluid pressure actuation device capable of overcoming the bias of the spring for displacing the piston into the first position.

16 Claims, 3 Drawing Sheets

BLOCK AND BLEED VALVE

BACKGROUND OF THE INVENTION

This invention relates generally to valves and more particularly to valves which regulate flow through two conduits at the same time. The two conduits are typically an inlet and an outlet conduit of a pump.

In high pressure pump (intensifier) applications, it is desired to limit the inlet and outlet flow of working fluid to and from the pump as the operation of the pump is altered. As the pump is shut off, it is desired to limit working fluid pressure applied to the pump wherein the working fluid will not leak into, or cause pressure damage to, the integral workings of the pump. It is desired to have a normally closed blocking valve to perform the function of shutting off the inlet valve as soon as the pump shuts down.

It is also desired to reduce the outlet pressure of the high pressure pump when the pump ceases operation. A separate bleed valve is typically applied to a t-portion of the outlet conduit, and is open to bleed the outlet conduit pressure as soon as the pump ceases operation. This bleed valve is distinct from the block valve.

The block valve and the bleed valve are typically solenoid operated; solenoid controlled and fluid operated; or fluid operated. The control signal to the valve may be electric or fluidic and is provided by the pump system. If either the electric or fluidic systems operating the valve fails, then the pump will not operated correctly. This situation can result in damage to the pump, valves, or interfacing system.

It is also possible that the signals from the pump that the block or bleed valve receives be incorrect while the other signal will be correct. This possible incorrect positioning of one of the valves is also highly undesirable. These block valves and bleed valves are relatively complex and expensive to construct and maintain. It would be highly desirable to produce a unitary block and bleed valve which is simple in construction and maintenance, and where both the block and the bleed portion of the valve are forced to operate in concert.

The foregoing illustrates limitations known to exist in present valve construction for pumps. It is apparent that it would be advantageous to provide an alternate directed to overcoming one or more of the limitations set forth above. Accordingly, a suitable alternate is provided including features more fully disclosed hereinafter.

SUMMARY OF THE INVENTION

In one aspect of the present invention, this is accomplished by providing a valve for use with a first working fluid conduit and a second working fluid conduit, the valve includes a valve body having a valve bore formed therein. A piston is slidably disposed within the valve body. A first opening and a second opening are formed within and defined by the valve body, the first opening being in communication with the first working fluid conduit and the second opening being in communication with the second working fluid conduit. The piston is displaceable in a first direction to a first position whereby working fluid passage through the second working fluid conduit is restricted. The piston is also displaceable in a second direction, opposed to the first direction, to a second position whereby working fluid passage through the first working fluid conduit is restricted. A biasing device is included for biasing the piston into the second position. A variable displacing fluid actuation device is also included for overcoming the biasing device and displacing the piston into the first position.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
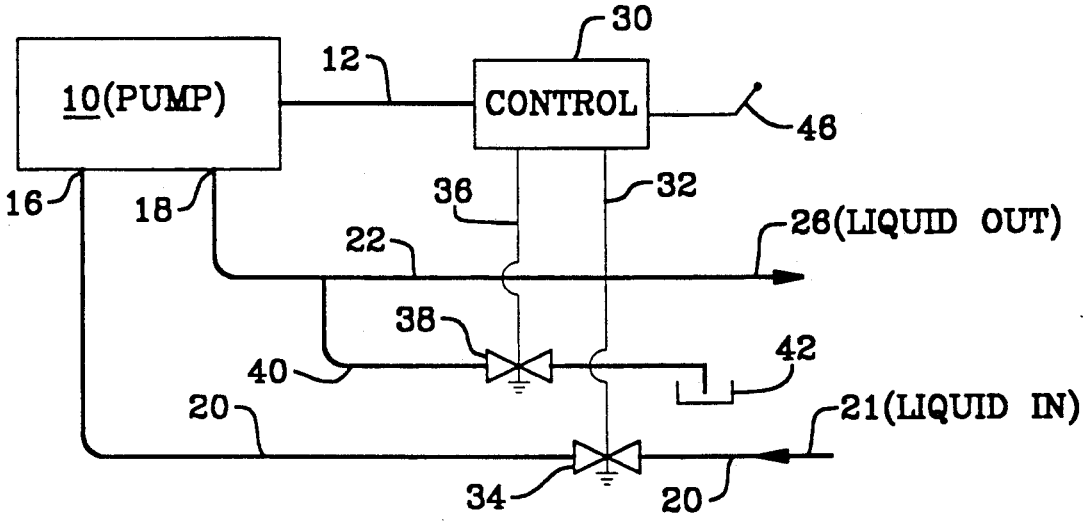
FIG. 1 (PRIOR ART)
FIG. 1 is a schematic view illustrating a prior art embodiment of working fluid inlet and outlet for a pump unit.

A pump is illustrated generally as 10. The pump, as used in this disclosure, is intended to cover a working fluid intensifier or similar pump or compressor used to pump fluids such as water under extremely high pressures. Examples of pumps or intensifiers which are often used for this application are illustrated in U.S. Pat. Nos. 4,621,988 and 4,526,000, incorporated herein by reference. One commonality of pumps used for these applications is that displacing fluid pressure (especially hydraulics) is applied through control conduit, alternatively called second working fluid port, 12 by control 30 to energize the pump 10.

The pump 10 receives its working fluid from a pump inlet 16 and discharges working fluid from a pump outlet 18. A first conduit 20 extends between the pump inlet 16 to a working fluid supply 21 while a second working fluid conduit 22 extends from the pump outlet 18 to a working fluid exit 26. The working fluid supply 21 supplies working fluid at normal supply pressures.

In the FIG. 1 embodiment, a control 30 is used to control the operation of the pump 10. The control 30 typically applies a pressurized second working fluid through the control conduit 12 to regulate operation of the pump 10. Electrical signal line 32 will send a signal from the control 30 to a normally closed solenoid valve 34. An electrical signal line 36 is connected between the control 30 and a high pressure normally open valve 38. Signals generated from the control 30 through electric signal lines 32 and 36 regulate the position of the normally closed solenoid valve 34 and the high pressure normally open valve 38, respectively.

The normally closed solenoid valve 34 is inserted in the first working fluid conduit 20. A t-portion 40 communicates the second working fluid conduit 22 with a low pressure reservoir 42. The solenoid pneumatic pilot valve is inserted in, and regulates working fluid flow through, the t-portion 40.

The operation of the FIG. 1 prior art embodiment is as follows. When the pump 10 is shut off, it is desired to close the normally closed solenoid valve 34 to limit flow of working fluid from the working fluid supply 21 to the pump 10. It is also desired to open the high pressure normally open valve 38. The operator positions an operators interface 46 into a shutoff position which regulates operation of the control 30. Based upon the position of the operators interface, signals are transmitted through electric signal lines 32 and 36 to close the normally close solenoid valve 34 and open the normally open valve 38, respectively. In this specification, the term signals will describe any type of signal which are commonly known in the art which permit actuation and de-actuation of the valves (for example rising edge trigger, falling edge trigger absence or presence of electrical impulse, etc.).

When the pump is operating, it is desired to open the normally closed solenoid valve 34 to permit working fluid flow to the pump 10 and to close the normally open valve 38 such that pressurized working fluid passing through the second conduit 22 to the working fluid exit is not dissipated through the normally open valve 38. Therefore, whenever the operators interface is displaced to any position excepting the shutoff position, a signal is generated from the control 30 through electric signal line 32 resulting in displacement of the normally closed solenoid valve from the normally closed position, and a signal is generated from the control 30 through electric signal line 36 resulting in displacement of the normally open valve 58 to the closed position. These displacements may be gradual depending upon the displacement of the operators interface 46 from the shutoff position.

Note from the above described operation that at each time that the normally open valve 38 is open that the normally closed solenoid valve 34 is closed, and vice versa. This operation permits a single block and bleed valve 60, in the FIGS. 2-6 embodiments, to accomplish the tasks previously accomplished by both normally open valve 38 and the normally closed solenoid valve 34. The remainder of the specification described the structure and the operation of the block and bleed valve 60.

The block and bleed valve has a valve body 62 which includes a first opening 64 and a second opening 66. The first opening 64 and the second opening 66 are in fluid communication with the first conduit 20 and the second conduit 22, respectively. In the FIGS. 2 and, 3 embodiment the first opening 64 is located on an axial side in a first direction 90 of a piston 68 while the second opening 66 is located on an axial side in a second direction 92 of the piston 68. In this specification, the first direction 90 is that direction towards which the piston 68 is biased when the valve is not actuated. By comparison, the second axial side 92 of the piston is that direction towards which the piston is biased when the valve is actuated.

Figure 3:
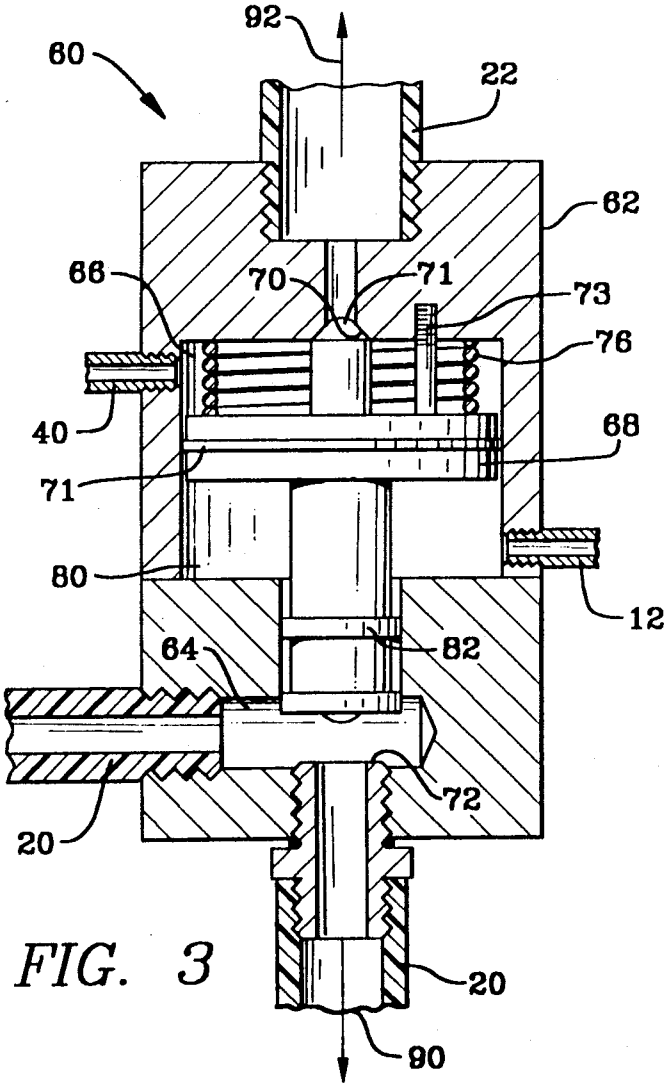
FIG. 3 is a view similar to FIG. 2 in the first, energized position.
Figure 2:
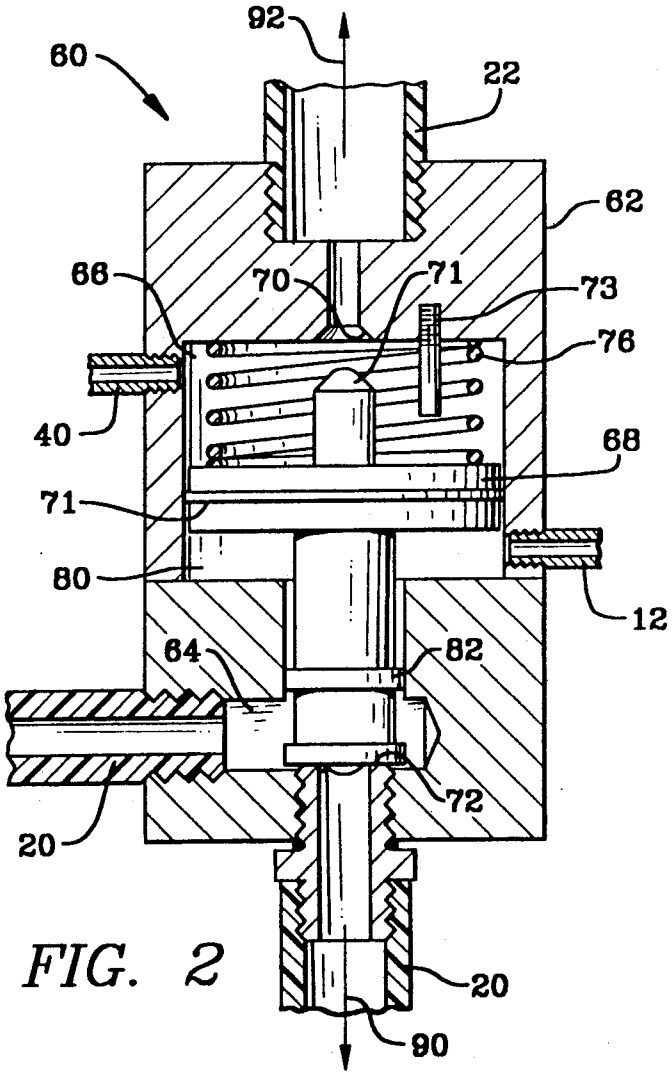
FIG. 2 is a cross sectional view of a block and bleed valve of one embodiment of present invention located in the second, de-energized position.

The piston 68 is slidably disposed within the valve body 62 between a first position illustrated in FIG. 3 and a second position illustrated in FIG. 2. A circumferential piston seal 71 is mounted circumferentially of the piston 68 and limits the flow of working fluid from the second opening 66 past the piston 68. When the piston is in the first position, a first valve seal 70 restricts passage of working fluid through the second conduit 22 When the piston is displaced to the second position, working fluid flow through the first conduit 20 is limited by contact between a second valve seal 72 and the piston 68.

A biasing means 76, illustrated as a spring, biases the piston 68 into the second position illustrated in FIG. 2. This is the position the valve is normally biased into. A pressurized second working fluid port 12 applies pressurized displacing fluid from outside the valve body 62 to a chamber 80 acting as a variable displacing fluid pressure actuation means capable of (when a displacing fluid pressure is applied) overcoming the biasing means for displacing the biasing means into the first position. A fluid seal 82 restricts working fluid passage between the chamber 80 and the first opening 64. The pressurized working fluid port 12 is in communication with of control conduit 12.

To reduce wear which occurs when a contact portion 71 of the piston 68 is forced into contact with the first valve seal 70, an adjustable stop screw 73 is threaded to the valve body 62. The adjustable stop screw 73 will extend the life of the first valve seal 70 by reducing impact between the contact portion 71 and the first valve seal 70.

Figure 4:
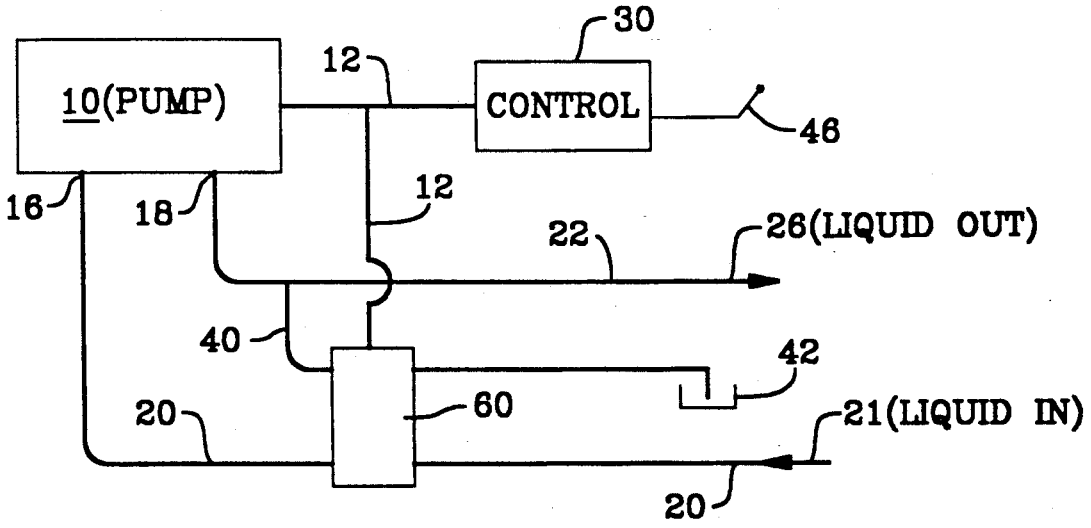
FIG. 4 is a schematic view illustrating the interconnection between the block and bleed valve of the present invention and a pump unit.

The operation of the FIGS. 2-4 embodiment of the present invention is as follows. When the operators interface 46 is in the shutoff position, no displacing fluid will be applied from the control 30 via control conduit 12. This ensures inactivity of the pump 10 while simultaneously ensuring that the block and bleed valve 60 is in the FIG. 2 second position under the influence of the biasing means 76. The first opening 64 will be in a block position restricting working fluid flow through the first conduit 20. Meanwhile the second opening will be in a bleed position permitting working fluid flow from the t-portion 40 of the second conduit to the low pressure reservoir 42.

As soon as the operators interface is shifted from the shutoff position, displacing fluid pressure is applied from the control 30 through the control conduit 12 to the pump 10, energizing the pump. This displacing fluid pressure in the control conduit 12 will displace the block and bleed valve into the first position illustrated in FIG. 3. The first opening is thereby displaced from the block position, permitting working fluid flow through the first conduit 20 to the pump 10. Simultaneously, the second opening 66 is displaced from the bleed position restricting working fluid flow through the t-portion 40 of the second conduit 22, thereby permitting the working fluid in the second conduit to build up in pressure at the working fluid exit 26.

Figure 5:
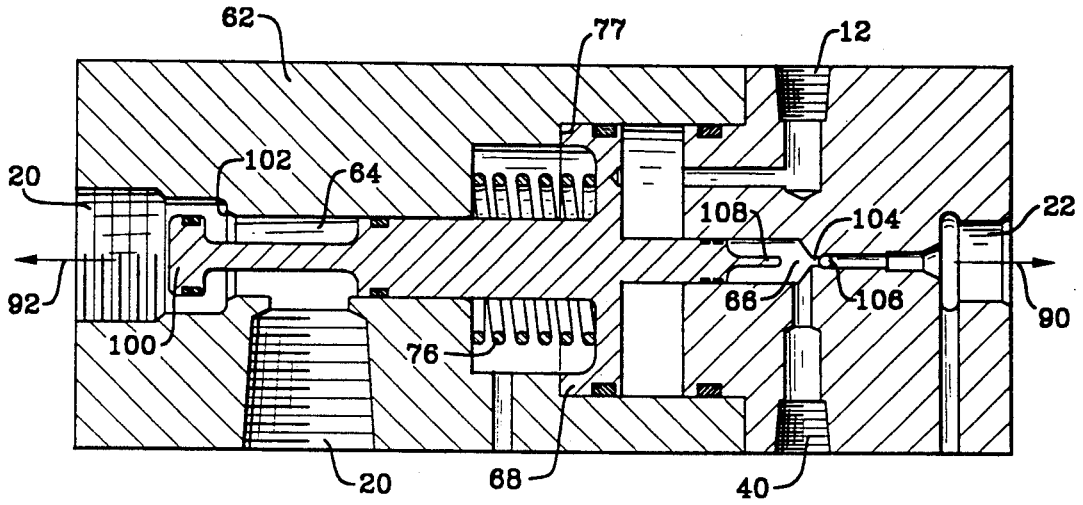
FIG. 5 is a cross sectional view of a block and bleed valve of another embodiment of the present invention wherein the valve is located in the first, energized position.
Figure 6:
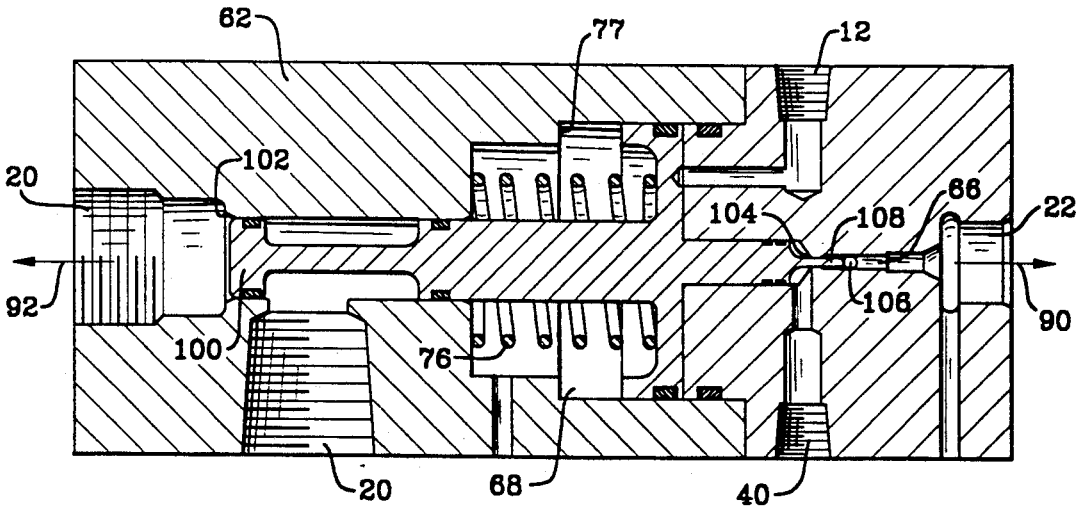
FIG. 6 is a view similar to FIG. 5, wherein the valve is in the second energized position.

An alternate embodiment of block and bleed valve of the present invention is illustrated in FIGS. 5 and 6. The piston 68 is axially displaceable within the valve body 62 to a first position illustrated in FIG. 5 and a second position illustrated in FIG. 6. In this embodiment, as opposed to the FIGS. 2 and 3 embodiment, the first opening 64 is located on the second axial side 92 of the piston 68 and the second opening 66 is on the first axial side 90 of the piston. In this embodiment the spring 76 reduces the resultant impact force as the piston 68 and the valve body 62 by the action of shoulder 77.

The first opening 64 of the FIGS. 5 and 6 embodiment is formed by a circumferential sealing head 100 which contact and seals with decreased diameter portion 102 when the piston is displaced into a first direction as illustrated in FIG. 6, restricting fluid passage through the second working fluid conduit 22 between the decreased diameter portion 102 and the circumferential sealing head 100. The second opening 66 includes a decreased diameter portion 104 which, with ball poppet element 106, define a valve. When the piston is displaced in the first direction, projection portion 108, which is attached to the piston 68, forces the ball poppet element 106 away from the decreased diameter portion 104 and permits working fluid to pass through the first working fluid conduit past the ball poppet element 106.

By comparison, when the FIGS. 5 and 6 embodiment is displaced into the second direction as illustrated in FIG. 5, by fluid inserted into the second pressurized working fluid port 12, the circumferential sealing head 100 is displaced from the decreased diameter portion and permits working fluid passage in the first working fluid conduit 20 past the first opening. Also, the projection portion is displaced away from the ball poppet element 106 resulting in a seal formed between the ball poppet element 106 and the decreased diameter portion 104 This results in restriction of fluid passage through the second working fluid conduit past the second opening.

There are important advantages in the present invention configurations over the prior art two valve system illustrated in FIG. 1. Initially, the present configuration is simpler and reduces the possibility that one out of two of the valves will malfunction. Second, the working fluid pressure applied through control conduit 12 which energizes the pump is the same working fluid pressure that actuates the block and bleed valve 60 compared to a separate electric signal which is required to energize the prior art solenoid valves. In a system that is under as high of a pressure as the block and bleed valve, it would be highly undesirable to have the valve be in the incorrect position based upon the operation of the pump. In conclusion, the present invention provides a simpler, less expensive design which performs the desired function in a superior manner.

While this invention has been illustrated and described in accordance with a preferred embodiment, it is recognized that other variations and changes may be made therein without departing from the invention as set forth in the claims.

Having described the invention, what is claimed is:

1. A valve which controls working fluid flow in a first working fluid conduit in communication with a pump inlet of a pump, the valve also controls working fluid flow in a second working fluid conduit in communication with a pump outlet of the pump, the valve comprises:

a valve body with a valve bore formed therein;

a piston slidably disposed within the valve body;

a first opening and a second opening formed within and defined by the valve body, the first opening is in communication with the first working fluid conduit and the second opening is in communication with the second working fluid conduit;

displacement of the piston in a first direction to a first position results in restriction of working fluid passage through the second working fluid conduit;

displacement of the piston in a second direction, opposed to the first direction, to a second position results in restriction of working fluid passage through the first working fluid conduit;

biasing means for biasing the piston into the second position; and variable displacing fluid pressure actuation means capable of overcoming the biasing means for displacing the piston into the first position.

2. The valve as described in claim 1, wherein a face of the piston partially defines the second opening.

3. The valve as described in claim 2., further comprising:

a circumferential piston seal mounted circumferentially of the piston to limit passage of the working fluid within the second opening past the piston.

4. The valve as described in claim 2, wherein the biasing means comprises a spring which biases the piston in the same direction as working fluid under pressure contained within the second opening.

5. The valve as described in claim 2, wherein the variable displacing fluid pressure actuation means comprises a second face of the piston.

6. The valve as described in claim 1, wherein the biasing means comprises a spring.

7. An apparatus comprising:

a pump having a pump inlet and a pump outlet;

control means for dispensing a displacing fluid which affects operation of the pump;

a first working conduit in communication with the pump inlet;

a second working conduit in communication with the pump outlet;

a valve including a valve body, the valve body having a valve bore formed therein;

a piston slidably disposed within the valve body;

a first opening and a second opening formed within and defined by the valve body, the first opening being in communication with the first working fluid conduit and the second opening being in communication with the second working fluid conduit;

the piston being displaceable in a first direction to a first position whereby working fluid passage through the second working fluid conduit is restricted;

the piston being displaceable in a second direction, opposed to the first direction, to a second position whereby working fluid passage through the first working fluid conduit is restricted;

biasing means for biasing the piston into the second position; and variable displacing fluid actuation means for overcoming the biasing means and displacing the piston into the first position.

8. The apparatus as described in claim 7, wherein a face of the piston partially defines the second opening.

9. The apparatus as described in claim 8, further comprising:

a circumferential piston seal mounted circumferentially of the piston to limit passage of the working fluid within the second opening past the piston.

10. The apparatus as described in claim 8, wherein the biasing means comprises a spring which biases the piston in the same direction as working fluid under pressure contained within the second opening.

11. The apparatus as described in claim 8, wherein the variable displacing fluid pressure actuation means comprises a second face of the piston.

12. The apparatus as described in claim 7, wherein the biasing means comprises a spring.

13. The apparatus as described in claim 7, wherein the variable displacing fluid actuation means controls operation of the pump.

14. The apparatus as described in claim 7 wherein the piston has a first axial side, which is that side opposed to where the piston is propelled when the variable displacing fluid actuation means is actuated; and a second axial side of the piston is that direction towards where the piston is propelled when the variable displacing fluid actuating means is actuated.

15. The apparatus as described in claim 14, wherein the second opening is on the first axial side of the piston and the first opening is on the second axial side of the piston.

16. The apparatus as described in claim 14, wherein the first opening is on the first axial side of the piston and the second opening is on the second axial side of the piston.

* * * * *